US011801957B2

(12) United States Patent
Monti

(10) Patent No.: US 11,801,957 B2
(45) Date of Patent: Oct. 31, 2023

(54) ENHANCED TAPING MACHINE AND OPERATING METHOD THEREOF

(71) Applicant: S.I.A.T. SOCIETA' INTERNAZIONALE APPLICAZIONI TECNICHE S.p.A., Turate (IT)

(72) Inventor: Andrea Monti, Turate (IT)

(73) Assignee: S.I.A.T. SOCIETA' INTERNAZIONALE APPLICAZIONI TECNICHE S.P.A., Turate (IT)

( * ) Notice: Subject to any disclaimer, the term of this patent is extended or adjusted under 35 U.S.C. 154(b) by 43 days.

(21) Appl. No.: 17/477,804

(22) Filed: Sep. 17, 2021

(65) Prior Publication Data

US 2022/0089308 A1 Mar. 24, 2022

(30) Foreign Application Priority Data

Sep. 18, 2020 (IT) ..... 102020000022048

(51) Int. Cl.
*B65B 51/06* (2006.01)
*B65B 7/20* (2006.01)
*B65B 57/04* (2006.01)

(52) U.S. Cl.
CPC ..... *B65B 51/067* (2013.01); *B65B 7/20* (2013.01); *B65B 57/04* (2013.01)

(58) Field of Classification Search
CPC ..... B65B 51/06; B65B 51/067; B65B 57/02; B65B 57/04; B65B 57/08; B65B 7/20
See application file for complete search history.

(56) References Cited

U.S. PATENT DOCUMENTS

2012/0102893 A1* 5/2012 Sambuca, Jr. ..... B65B 59/005 53/476
2013/0174962 A1* 7/2013 Fasse ..... B65H 37/04 156/324

FOREIGN PATENT DOCUMENTS

CN 109229601 1/2019
DE 20 2020 105102 10/2020
TW M595093 U * 5/2020 ..... B31B 50/0044

OTHER PUBLICATIONS

Translation of TWM595093U, Lai, Yu Ting, May 2020 (Year: 2020).*
Search Report for IT2020000248, dated May 27, 2021, 1 page.

* cited by examiner

*Primary Examiner* — George R Koch
(74) *Attorney, Agent, or Firm* — NIXON & VANDERHYE

(57) ABSTRACT

Disclosed is a box taping machine equipped with a conveying mechanism for boxes and one or more tape applicators. The taping machine can be manually or automatically adjusted, with or without flap folding. A conveying unit displaces boxes along a sliding plane, moved by an actuator controlled by a drive, with a tape applicator positioned above the plane. A passage sensor detects the moving position of at least a vertical surface of the boxes and outputs sensor signals. A programmable logic unit interfaces with the passage sensor and drive, computing a current position of front and rear vertical surfaces based on the sensor signal, and an actuator control function acts on the drive controlling the actuator, the actuator control function being variable in time based on the current position of front and rear vertical surfaces of the boxes. A retrofit kit and corresponding method are also disclosed.

6 Claims, 2 Drawing Sheets

ENHANCED TAPING MACHINE AND OPERATING METHOD THEREOF

CROSS-REFERENCE TO RELATED APPLICATION

This application claims priority to IT Application No. 102020000022048, filed Sep. 18, 2020, the entire contents of which are hereby incorporated by reference.

BACKGROUND OF THE INVENTION

Field of the Invention

The present invention relates to a box taping machine equipped with a conveying mechanism for boxes and one or more tape applicators. The taping machine can be manually or automatically adjusted, with or without flap folding.

Description of the Related Art

As known, packaging machines are used in the packaging sector that close containment boxes, usually made of corrugated cardboard, and seal them with self-adhesive tape or with pre-gummed tape. The boxes typically have pairs of opposing flaps that are folded together until they come into contact and joined by adhesive tape laid along an axis of the box.

Typically, at a preliminary stage of packaging, the flaps on a bottom side of a box are closed back together (and possibly taped) to form the bottom of the packaging container. The box is then filled with the desired objects (e.g., a plurality of small items in bulk) and finally routed to a taping machine. The latter is provided with a conveying mechanism, for example motorized feed belts, which engage the box bottom and guide it through a path along which the box encounters one or two opposing tape applicators (typically an upper and a lower one) which provide for the accurate application of the adhesive tape so as to fix and seal the flaps (either on a single top side or on bottom and top opposing sides), normally along the central axis of the box.

The application phase of the tape is critical because, while the box is moving forward on the conveyor, it is necessary to fix an initial end of the adhesive tape on the vertical side of the box, then along the (upper and/or lower) horizontal side of the flaps and finally, for a short terminal end, also on the rear vertical side. The adhesive tape must be adhered perfectly to both the vertical and the horizontal sides, to ensure the tightness of the packaging.

This way of proceeding obviously requires a special tape applicator, which is able to act on both a vertical and a horizontal side, also working on the 90° edge that connects the two sides, with the right pressure and the correct tape delivery speed.

A semi-automatic taping machine of prior art is for example the model "XL35" produced by the same Applicant and represented in FIG. 1. Typically, a transport roller conveyor 2 is provided on a support frame 1, which defines a sliding plane for boxes (not shown), upon which there are arranged two conveyor belt parallel units 3*a* and 3*b*, with feed belts N arranged on a loop around vertical axes and carried in motion by respective motors Ma and Mb: when the box to be closed comes into engagement with the belts N, it is dragged along the longitudinal axis of the machine resting on the roller conveyor 2.

The specific arrangement of the transport system may also be different.

A tape applicator 4 is mounted above the sliding plane, at a height that can be matched to the height of the boxes. This is called top applicator.

The top tape applicator 4 has at least one slide shoe 4*a*, inside which a number of application rollers 4*b* are housed, located along a longitudinal axis, which distribute an adhesive tape coming from a tape reel 4*c* and apply it by pressure contact on the surfaces of the box, so as to properly seal the closing flaps each other.

Optionally, a similar bottom tape applicator 5 is provided, arranged in a mirror-like fashion below the sliding plane of the boxes, with a slide shoe 5*a*, application rollers 5*b*, and a tape reel 5*c*.

As shown schematically in FIG. 2, during the passage of a box S, upon the contact of the box surfaces with the application rollers 4*b* (and possibly also with the rollers 5*b* of a lower unit 5), the adhesive tape which seals the flaps of the box S in the closed position is applied.

In the context of this application, no further detailed information will be provided on the construction and operation of a manual or automatic adjustment taping machine, because it is well known as such to the skilled men in the relevant technical field.

The feed speed of the conveyor system, for example of the two conveyor belt units, shall be tuned according to the tape applicator features, in a way that allows the box to be engaged by the tape applicator for a sufficient time to complete a good quality taping. This clearly represent a limitation with respect to the free speed at which the box may be delivered on the conveying system.

DE202020105102U1 discloses a carton sealing machine having a conveying unit which offer a partial solution to the above problem. In fact, the sealing machine is equipped with a sensor unit which outputs a control signal to a control unit when it is detected that a forward-facing surface of a carton is passing by. The control unit controls the conveying system to operate in a standard high speed to convey the cartons and at low-speed mode for a predetermined period of time upon receipt of the control signal. In this way, only when a tape adhering operation is in progress the conveying unit is in the low-speed mode, while for the rest the high speed is used.

However, this operation mode is still far from being optimal.

SUMMARY OF THE INVENTION

The inventor of the application has indeed realized that the actual limitation of performances is mainly due to a short duration of the most critical phase of operation, i.e. the application of the tape at the beginning of taping, when the tape shall be applied to the front vertical side, and at the end of taping, when the tape shall be applied on the rear vertical side, although on the horizontal side(s) a higher speed would be tolerable to apply the tape properly.

In particular, the critical steps for the correct application of the tape occur:

- when a contact point of the box encounters an inlet application roller of the applicator and the application of the tape shall proceed on the front face surface and later on the transition edge surface between the vertical surface and the horizontal surface; the box advances towards the inlet tape applicator contact member, typically a rubberized roller (as indicated by 4*b* in the figures), and if the contact speed is too high there is a risk of damaging the box or of the tape not adhering.
- when the last applicator roller approaches the end of the box horizontal side and the tape shall be laid around the terminal transition edge and then on the surface of the rear vertical surface, before being cut; in this phase, in fact, the box moves away from the last contact member of the tape applicator, typically a rubberized roller, and if the removal speed is too high, the contact member of the tape applicator cannot make enough pressure on the box and the tape remains detached from it.

During these steps, the conveyor system speed must be adapted to the tape applicator ability to follow the box profile, the inertia of the incoming system (from the stationary tape to the tape during application) and the tape cut capacity of the taping machine. There is therefore an operational limit to the running speed of the conveyor system.

Intuitively, this limit has a greater influence on throughput of the machine when handling long boxes than on short ones, because in the former the ratio between the length of the horizontally deposited tape with respect to the length of the vertically deposited tape is greater.

It follows that the throughput of these machines is not optimal, even if a system like the one disclosed in DE202020105102U1 is employed.

It is therefore desired to be able to offer an improved taping machine, which allows to achieve greater throughput, while maintaining a high quality of application of the adhesive tape also on the vertical sides of the box; said in other words, it is desired to increase the quality of application of the adhesive tape with equal throughput, typically when using cardboard boxes or lower quality adhesive tapes.

BRIEF DESCRIPTION OF THE INVENTION

The object of the present invention is, therefore, to provide a taping machine which overcomes the limits of the prior art.

A solution according to the invention is achieved by means of a taping machine having the features defined in the independent claims appended hereto. Other preferred features of the invention are defined in the dependent claims.

The proposed solution makes it possible to reduce the effects of the constraints on the approaching speed of the vertical faces of the box to the applicator rollers, increasing throughput while improving the quality of the taping process.

In the rest of the cycle (box transfer, upper/lower horizontal side taping) the speed may be advantageously higher.

The solution of the invention provides in particular of:

1. implementing of a drive capable of adjusting the feed speed of the box during the machine crossing phase;
2. installing sensors that detect the beginning and the end of the box;
3. allowing a programmable logic (software) to adjust the speed of the box during the taping process according to customizable profiles.

BRIEF DESCRIPTION OF THE DRAWINGS

Further features and advantages of the invention will anyhow be more evident from the following detailed description of preferred embodiments of the same, provided by mere way of non-limiting example and illustrated in the accompanying drawings, wherein.

DESCRIPTION OF THE PREFERRED EMBODIMENTS

Figure 3:
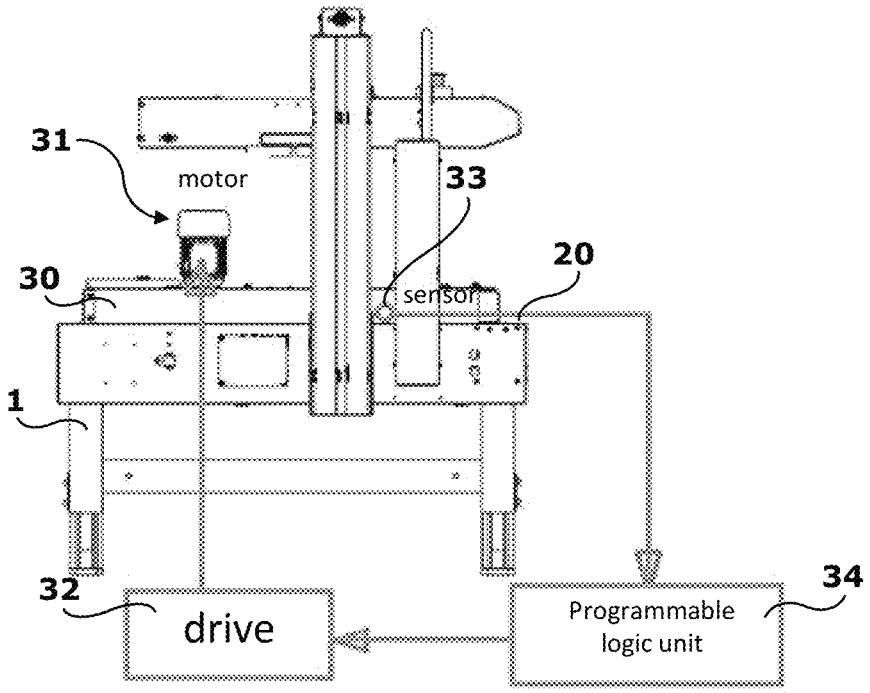
FIG. 3 is a diagram elevation view of the taping machine of FIG. 1, on which the control logic according to the invention is shown schematically.

An exemplary taping machine is shown in FIG. 3 (where tape applicators have been removed for sake of clarity). The difference between a machine with automatic or manual adjustment lies in the ability to automatically adjust or not the height of the top tape applicator and the position of the conveying mechanism to the dimensions of the box to be sealed; this is not relevant for the teaching of the invention.

Figure 1:
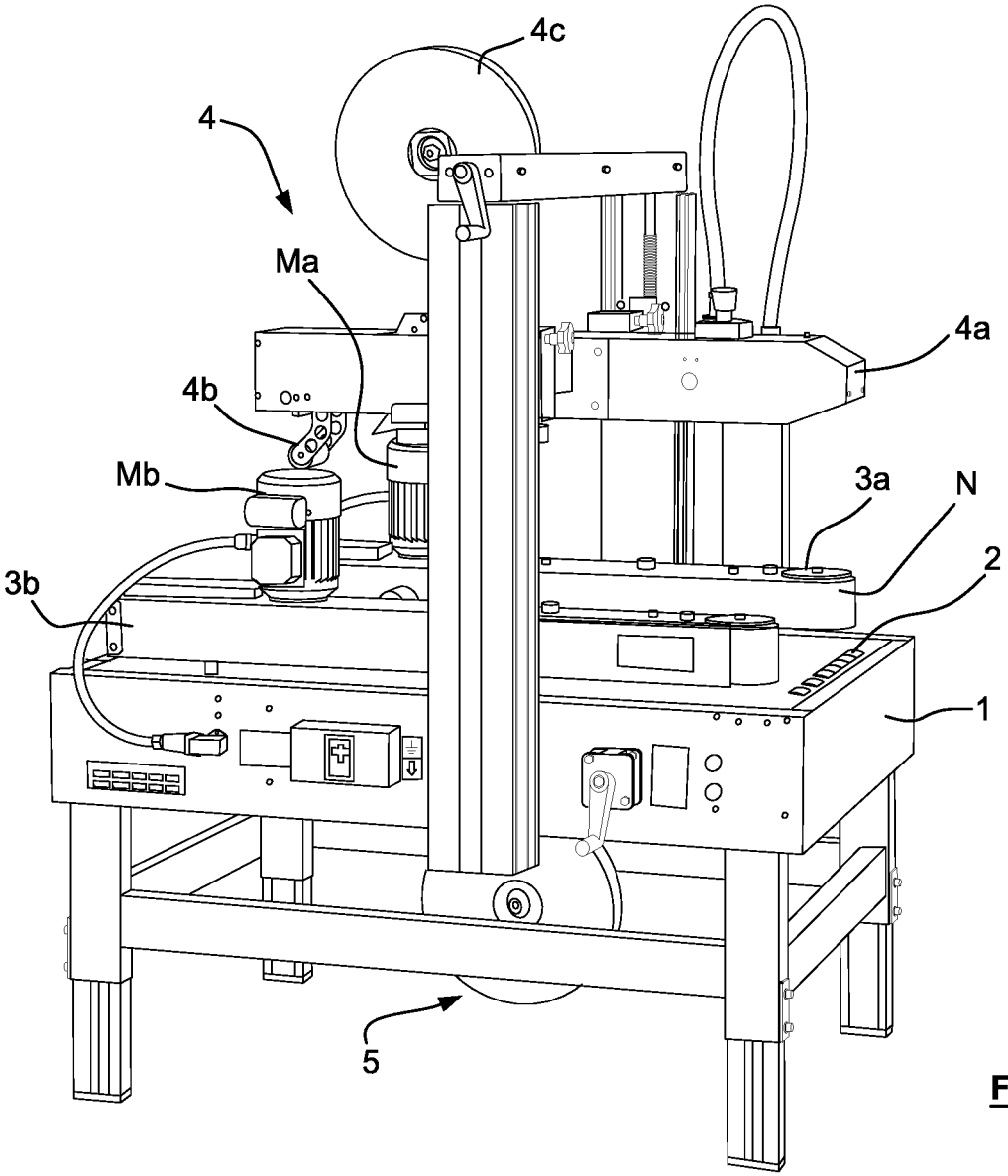
FIG. 1, as anticipated, is a perspective view of an exemplary taping machine.
Figure 2:
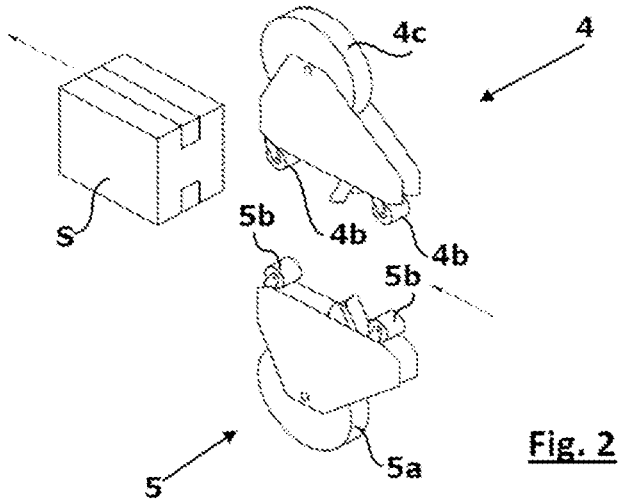
FIG. 2 is a perspective partial view with removed parts, showing the functional relationship between a box and a pair of tape applicators.

As already indicated with reference to FIG. 1, the machine has a frame 1 on which an automatic transport system is mounted that defines a sliding plane 20 and comprises at least one conveying unit 30 set in motion by an actuator 31, such as one or more electric motors.

Above the sliding plane—optionally also below—a tape applicator (not illustrated in FIG. 3) is provided, intended to apply a sealing adhesive tape to a box during the running movement of the latter through the machine by means of the conveying unit 30.

In a per se known manner, the actuator 31 is driven by a drive 32—for example a suitably programmed firmware drive and resident in a console of the machine—which determines the feed speed of the conveying unit 30. The drive 32 is normally programmed so that an operator can change the feed speed of the conveying unit according to requirements (based on the size and weight of the boxes, for example). The operator, also on the basis of experience, can adjust the feed speed by acting on adjustment means of conveying unit 30 and verifies that this speed does not give rise to malfunctions for a certain type of box to be treated. However, the feed speed remains constant over time for each operator setting. Once the correct feed speed has been identified, the adjustment means of the conveying unit 30 are no longer modified for the entire time that the machine must treat that type of box.

Other embodiments provides that a sensor unit is able to detect the approaching of a front surface of the box, so as to automatically switch the feed speed from a high conveying level to a low taping level for a predetermined amount of time, when the box is running through the machine, and it is engaged by the tape applicator.

By contrast, according to the invention, a passage sensor 33 is also installed on the taping machine, fixed to the frame 1, preferably at an inlet side of the machine. The passage sensor 33 is arranged so as to detect passage of a vertical surface of a box in a position upstream of an inlet applicator roller of the tape applicator. The passage sensor 33 detects the passage of the vertical surface of the front side of a box S and the passage of the vertical surface of the back side of the box S and output correspondingly at least a couple of respective sensor signals.

The passage sensor 33 is for example an optical sensor; alternatively, an ultrasonic sensor can be used to locate the position of a box surface.

The passage sensor 33 is also connected to a programmable logic unit 34, interfaced with the drive 32 and possibly integrated into the same console where the drive 32 resides.

The signals emitted by the passage sensor 33 may be an analog or digital signal.

The programmable logic unit 34—consisting of hardware, software, or a specific hardware and software composition—defines an actuator control function F that is variable in time based on the sensor signals from the passage sensor 33. In particular, the actuator control function F is used to drive the actuator 31 so as to finally determine a variable speed profile of the conveying unit 30, so that the speed profile varies within the time frame in which a single box runs through the taping machine.

The actuator control function F implemented in the programmable logic unit 34 determines a speed profile of the actuator 31 as a function of the position of the box with respect to the tape applicator, namely to the inlet applicator roller, on the frame 1 of the taping machine.

In particular, the position of the front and rear vertical surfaces is computed in time based on the two signals from the passage sensor 33.

The current position of the box front and rear vertical surfaces is computed by the programmable logic unit 34 as a function of the sensor signal from the passage sensor 33 and the time and feed speed; alternatively, said current position can be measured directly by means of an ultrasonic sensor or the like.

A speed profile is computed based on the current position of the box front and rear vertical surfaces.

Figure 4:
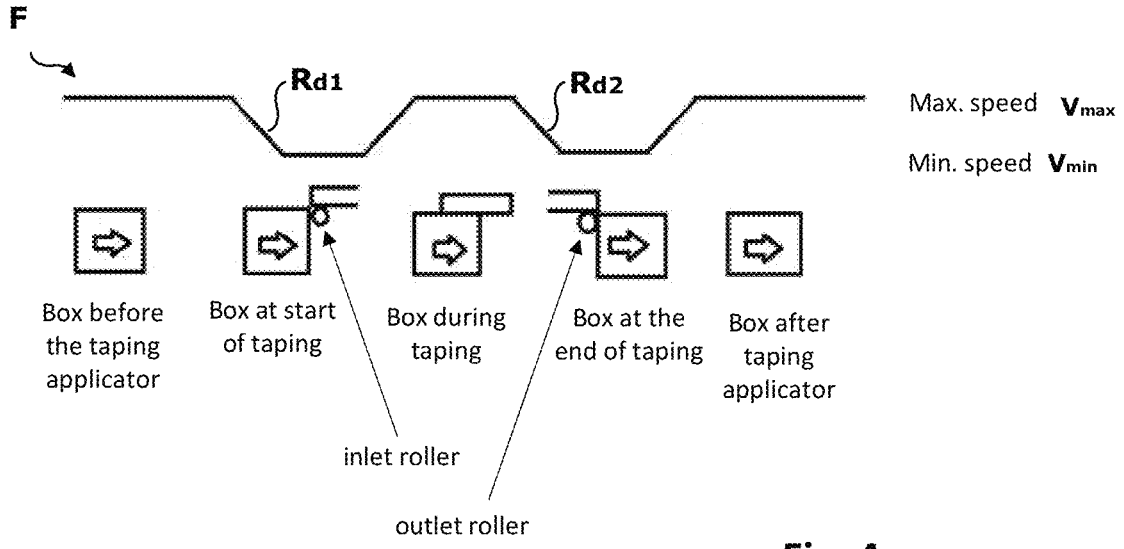
FIG. 4 is an exemplary graph of a speed profile of the conveyor system according to the invention.

An exemplary speed profile determined by the actuator control function F is shown in FIG. 4, plotted against the position of a box along the path through the taping machine.

In particular, as long as the box S does not engage the passage sensor 33, it is at the maximum speed level Vmax.

When the front vertical surface of the box is detected by the passage sensor 33, the programmable logic unit 34 begins to compute the position of the front vertical surface of the box along the path by determining a reduction ramp $R_{d1}$, possibly delayed, in the speed profile of the actuator 31, for example by bringing the feed speed to a minimum speed value Vmin.

After the front vertical surface of the box has come into contact with an inlet roller of the applicator and the point of application of the adhesive tape has exceeded the transition edge with the horizontal side, the speed profile can return to the level of the maximum speed Vmax by means of an appropriately shaped ascending ramp.

Then, based on a sensor signal output by the passage sensor 33 upon detecting the rear vertical surface of the box, the current position of said rear vertical surface can be computed. Alternatively, if the size or the longitudinal length of the box is set in the programmable logic unit 34, the current position of the rear vertical surface of the box can be computed based only on the sensor signal output upon detecting the front vertical surface.

When the current position of the rear vertical surface of the box has almost reached the position of an outlet roller of the tape applicator, the speed profile again has a reduction ramp $R_{d2}$, to return to the minimum speed value Vmin up to an end point of application of the adhesive tape, so as to complete the application of the adhesive tape on the rear transition edge and on the rear vertical surface of the box, as well as to cut the adhesive tape, at a speed suitable for this critical interaction on the rear surface of the box.

Finally, when the box moves away from the tape applicator, the speed profile has a new ascending ramp towards the maximum speed Vmax.

The speed profile shown in FIG. 4 can also have variations, depending on the type of drive 32 and actuator 31 used, as well as the specific construction elements used in the conveying unit 30. In fact, the inertia and structural strength of the moving components, the power that can be expressed by the actuator 31 or the response speed of the electronic components and software used in the drive 32 and in the programmable logic unit 34 can represent constraints to the accelerations permissible in the speed profiles.

For example, the first minimum speed value Vmin reached when the box is approaching the inlet roller of the tape applicator can be different to the second minimum speed value Vmin reached when the box is leaving the outlet roller of the tape applicator.

Further, it can be expected that the steady speed levels are not only two or three. For example, it is expected that the actuator 31 will be driven at an intermediate speed Vmean in the phase in which the adhesive tape is applied to the horizontal top/bottom surface of the box, i.e. after the transition edge of the front vertical surface has passed the first point of application (inlet roller) of the adhesive tape and before the transition edge of the rear vertical surface has affected the end point of application (outlet roller) of the adhesive tape.

Especially in the case where small boxes need to be sealed, a profile that provides for an average speed Vmean lower than the maximum speed Vmax, is more manageable by the actuator 31, without the need for excessive resources and still obtaining productivity advantages.

Moreover, although straight ramp profiles have been shown in FIG. 4, it is envisaged that the ascending and descending speed ramps can have shapes and slopes that better connect with the minimum and maximum maintenance speeds, in order to limit accelerations and achieve greater feed stability.

The programmable logic unit 34 allows the user both to recall predefined profiles (programs)—so as to adopt the most suitable profile either manually or through automatic box recognition sensors (detecting the size and/or weight, a typed barcode or else)—as well as to define new profiles (in terms of absolute speed values or percentage variations thereof and/or in terms of intervention positions of variations).

As can be understood, the taping machine thus configured, equipped with a passage sensor and programmable logic unit to adjust the speed of the actuator when the box is running through the machine, allows to perfectly achieve the purposes stated in the preamble, with a series of advantages.

First of all, as can be easily realized, the management of the variable profile of the feed speed, allows to obtain considerable productivity advantages compared to a traditional machine that operates continuously at a minimum speed, although optimized, for compatibility with the phases of engagement and disengagement of the box with the tape applicator.

Furthermore, since the invention provides for an intervention only on the actuator part and drive system, it can also be applied to existing taping machines without having to alter the overall design choices, nor by replacing mechanical parts or parts specifically designed for these machines.

Ultimately, this solution also allows to reconfigure taping machines already operating in the field (retrofitting), simply by providing a kit containing a passage sensor to be fixedly mounted on the machine frame and a preconfigured electronic board with programmable logic, to be interfaced with the control electronics of the pre-existing actuator.

It is however understood that the invention is not limited to the particular configuration illustrated, which represents a non-limiting example of its scope, but that numerous variants are possible, all within the reach of a skilled in the art, without thereby departing from the scope of the invention.

For example, although for sake of simplicity it has always been referred to a box with a rectangular base, it is not excluded that the taping machine can be used to tape boxes of a very different or bizarre shape. Depending on the critical surfaces for the application of the tape, programmable logic unit can be configured to adapt the speed profile to the signals coming from the passage sensor, which will be able to detect the approaching or leaving away of a target surface as identified on the intended box.

The invention claimed is:

1. A taping machine comprising:

a conveying system which defines a sliding plane, the conveying system being configured to convey a plurality of boxes to be sealed with adhesive tape, the conveying system comprising:

a conveyor configured to displace said boxes, the conveyor being set in motion by an actuator controlled by a drive, a tape applicator provided above said sliding plane, the tape applicator configured to apply sealing adhesive tape on said plurality of boxes during displacement thereof, the tape applicator including at least an inlet applicator roller and an outlet applicator roller configured to contact a surface of said boxes during application of the adhesive tape, a passage sensor fixed with respect to said sliding plane, the passage sensor being configured to detect a moving position of at least one vertical surface of said boxes and to output a respective sensor signal, and programmable logic interfaced with the passage sensor and said drive, wherein a current position of both a front vertical surface of the at least one vertical surface and a rear vertical surface of the at least one vertical surface of said boxes is computed based on said sensor signal, wherein the programmable logic includes an actuator control function implemented to act on said drive controlling the actuator, wherein said actuator control function is variable in time based on said current position of both said front vertical surface and said rear vertical surface of said boxes and to operate the taping machine by:

conveying the plurality of boxes to be sealed with the adhesive tape on said sliding plane by the conveyor toward the tape applicator to apply the sealing adhesive tape on said plurality of boxes during the displacement thereof, detecting a front vertical surface of a respective one of the boxes by the passage sensor, and computing a position of the front vertical surface of the respective box along a path by determining a reduction ramp in a speed profile of the actuator, when the front vertical surface of the respective box is detected by the passage sensor, and wherein a conveying feed speed profile of said respective box is:

(i) varied after said front vertical surface of the respective box comes into contact with said inlet applicator roller and a point of application of the adhesive tape exceeds a transition edge with a horizontal side, returning to a level of a maximum speed by an ascending ramp, (ii) varied again when the current position of a rear vertical surface of the respective box almost reaches the position of said outlet applicator roller, having a reduction ramp, to a minimum speed value up to an end point of application of said adhesive tape, and (iii) then, when the respective box moves away from the tape applicator, the conveying feed speed profile has a new ascending ramp toward the maximum speed.

2. The taping machine as in claim 1, wherein said sensor signal coming from the passage sensor is used by said programmable logic to determine said current position of the front and rear vertical surfaces of said plurality of boxes with respect to the inlet applicator roller and the outlet applicator roller of said tape applicator, respectively.

3. The taping machine as in claim 1, wherein said conveying feed speed profile has the reduction ramp and the ascending ramp between the maximum speed and a transit speed, said maximum speed being used before and after said box is engaged by said tape applicator and said transit speed being used at least when said front and/or rear vertical surface is close to the point of application of the adhesive tape by said tape applicator.

4. A retrofit kit for a taping machine, the retrofit kit comprising:

a passage sensor configured to be fixedly mounted with respect to a sliding plane of the taping machine, the passage sensor being configured to detect the movable position of at least a vertical surface of a plurality of boxes and to output a respective sensor signal; and a preconfigured electronic board implementing a programmable logic configured to be interfaced with said passage sensor and a drive of an actuator controlling a motion of a conveyor of said boxes, wherein said programmable logic is configured so that a current position of both a front vertical surface and a rear vertical surface of said boxes is computed based on said sensor signal, wherein an actuator control function is implemented to act on said drive of the actuator, said actuator control function being variable in time based on said current position of both the front vertical surface and the rear vertical surface of said boxes to operate the taping machine by:

conveying the plurality of boxes to be sealed with adhesive tape on said sliding plane by the conveyor toward a tape applicator to apply sealing adhesive tape on said plurality of boxes during displacement thereof, the tape applicator including at least an inlet applicator roller and an outlet applicator roller configured to contact a surface of said boxes during application of the adhesive tape, detecting a front vertical surface of a respective one of the boxes by the passage sensor, and computing a position of the front vertical surface of the respective box along a path by determining a reduction ramp in a speed profile of the actuator, when the front vertical surface of the respective box is detected by the passage sensor, and wherein a conveying feed speed profile of said respective box is:

(i) varied after said front vertical surface of the respective box comes into contact with said inlet applicator roller and a point of application of the adhesive tape exceeds a transition edge with a horizontal side, returning to a level of a maximum speed by an ascending ramp, (ii) varied again when the current position of a rear vertical surface of the respective box almost reaches the position of said outlet applicator roller, having a reduction ramp, to a minimum speed value up to an end point of application of said adhesive tape, and (iii) then, when the respective box moves away from the tape applicator, the conveying feed speed profile has a new ascending ramp toward the maximum speed.

5. An operating method of a taping machine including a conveying system which defines a sliding plane and being configured to convey a plurality of boxes to be sealed with adhesive tape, the conveying system including a conveyor configured to displace the boxes and being set in motion by an actuator controlled by a drive, a tape applicator provided above the sliding plane and configured to apply sealing adhesive tape on the plurality of boxes during displacement thereof, and a passage sensor fixed with respect to the sliding plane and being configured to detect a moving position of at least one vertical surface of the boxes and to output a respective sensor signal, the method, comprising:

conveying the plurality of boxes to be sealed with the adhesive tape on the sliding plane by the conveying the sealing mechanism toward the tape applicator to apply adhesive tape on said plurality of boxes during the displacement thereof, said tape applicator including at least an inlet applicator roller and an outlet applicator roller configured to contact a surface of said boxes during application of the adhesive tape;

detecting a front vertical surface of a respective one of the boxes by the passage sensor; and computing a position of the front vertical surface of the respective box along a path by determining a reduction ramp in a speed profile of the actuator, when the front vertical surface of the respective box is detected by the passage sensor, wherein a conveying feed speed profile of said respective box is:

(i) varied after said front vertical surface of the respective box comes into contact with said inlet applicator roller and a point of application of the adhesive tape exceeds a transition edge with a horizontal side, returning to a level of a maximum speed by an ascending ramp, (ii) varied again when the current position of a rear vertical surface of the respective box almost reaches the position of said outlet applicator roller, having a reduction ramp, to a minimum speed value up to an end point of application of said adhesive tape, and (iii) then, when the respective box moves away from the tape applicator, the speed profile has a new ascending ramp toward the maximum speed.

6. The operating method as in claim 5, wherein a current position of both the front vertical surface and the rear vertical surface is detected by the passage sensor, and a condition in which one of said boxes is in contact with said inlet applicator roller and said outlet applicator roller leaves the contact with said one box is determined based on said current position detected by the passage sensor.

* * * * *